US009786447B2

(12) United States Patent
Reid et al.

(10) Patent No.: US 9,786,447 B2
(45) Date of Patent: Oct. 10, 2017

(54) MOUNTING ASSEMBLY FOR A CIRCUIT BREAKER MECHANISM

(71) Applicant: General Electric Company, Schenectady, NY (US)

(72) Inventors: Ansel Omar Reid, Middletown, CT (US); Christie Marie Barbera, Middlebury, CT (US); Katherine Marjorie Coughlin, West Hartford, CT (US); Wolfgang Meyer-Haack, Neumunster (DE)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 258 days.

(21) Appl. No.: 14/592,492

(22) Filed: Jan. 8, 2015

(65) Prior Publication Data

US 2016/0203922 A1 Jul. 14, 2016

(51) Int. Cl.

| | |
|---|---|
| ***H01H 1/64*** | (2006.01) |
| ***H01H 1/66*** | (2006.01) |
| ***H01H 9/02*** | (2006.01) |
| ***H01H 71/02*** | (2006.01) |

(52) U.S. Cl.
CPC ..... *H01H 9/02* (2013.01); *H01H 71/02* (2013.01); *H01H 2211/02* (2013.01)

(58) Field of Classification Search
CPC ..... H01H 9/02; H01H 2211/02
USPC ..... 200/293, 400, 401; 335/202
See application file for complete search history.

(56) References Cited

U.S. PATENT DOCUMENTS

| | | | | |
|---|---|---|---|---|
| 3,178,547 | A | 4/1965 | Brumfield | |
| 3,398,249 | A | 8/1968 | Dessert | |
| 3,477,044 | A | 11/1969 | Gryctko | |
| 3,588,619 | A | 6/1971 | Layton | |
| 4,754,247 | A * | 6/1988 | Raymont | H01H 71/0228 200/303 |
| 5,424,701 | A * | 6/1995 | Castonguay | H01H 3/30 200/400 |
| 6,680,842 | B1 | 1/2004 | Pelaez | |
| 8,284,542 | B2 | 10/2012 | Siebels | |
| 8,737,043 | B2 | 5/2014 | Hughes | |

FOREIGN PATENT DOCUMENTS

| | | |
|---|---|---|
| JP | 2002208341 A | 7/2002 |
| WO | 2002021556 A1 | 3/2002 |

OTHER PUBLICATIONS

Siemens Product Brochure (Bulletin SIB 2.7-9), "I-T-E Molded Case Circuit Breakers," 1992; 32 pgs.

* cited by examiner

*Primary Examiner* — Renee Luebke
*Assistant Examiner* — Lheiren Mae A Caroc
(74) *Attorney, Agent, or Firm* — GE Global Patent Operation; Stephen G. Midgley

(57) ABSTRACT

A mounting assembly for a circuit breaker mechanism includes a base and a mid-cover disposed adjacent the base. Also included is a first pair of mounting posts comprising a first mounting post and a second mounting post extending from the base, the first pair of mounting posts each protruding through the mid-cover. Further included is a first mount hole defined by the first mounting post and a second mount hole defined by the second mounting post. Yet further included is a first pin extending through the first mount hole, the second mount hole and a circuit breaker mechanism frame to retain the circuit breaker mechanism to the base.

20 Claims, 5 Drawing Sheets

MOUNTING ASSEMBLY FOR A CIRCUIT BREAKER MECHANISM

BACKGROUND OF THE INVENTION

The subject matter disclosed herein relates to circuit breakers and, more particularly to a mounting assembly for mounting a circuit breaker mechanism to a base.

Circuit breakers are used to protect equipment from overcurrent situations caused, for example, by short circuits or ground faults in or near such equipment. A circuit breaker may be manually switched from an "ON" condition to an "OFF" condition and vice versa. Additionally, the circuit breaker includes a mechanism that is configured to automatically switch the circuit breaker to an "OFF" (e.g., "TRIP") position in response to an undesirable operating situation, such as a short circuit, for example.

The mechanism is mounted to a base of the circuit breaker typically in one of two manners. First, the mechanism may be mounted directly to the base at a position close to several "live" components of the circuit breaker that are located on or within the base. Second, the mechanism may be isolated from the "live" components by mounting the mechanism on an outer surface of a mid-cover that is coupled to the base. Isolating the mechanism is desirable, but such a mounting configuration requires several intermediate mounting components to electrically connect the mechanism to the base. Any system employing a number of components attached to each other will exhibit tolerance stack-up. Reducing the effect of undesirable tolerance stack up is generally effected through more precise manufacturing processes. Therefore, achieving the benefit of isolation associated with mounting on the outer surface of a mid-cover is tempered by increased manufacturing challenges and cost.

BRIEF DESCRIPTION OF THE INVENTION

According to one aspect of the invention, a mounting assembly for a circuit breaker mechanism includes a base and a mid-cover disposed adjacent the base. Also included is a first pair of mounting posts comprising a first mounting post and a second mounting post extending from the base, the first pair of mounting posts each protruding through the mid-cover. Further included is a first mount hole defined by the first mounting post and a second mount hole defined by the second mounting post. Yet further included is a first pin extending through the first mount hole, the second mount hole and a circuit breaker mechanism frame to retain the circuit breaker mechanism to the base.

According to another aspect of the invention, circuit breaker includes a base and a mid-cover disposed adjacent the base. Also included is at least one mounting post extending from the base and protruding through the mid-cover, the at least one mounting post having an end located at a distal location from the base. Further included is at least one mount hole defined by the at least one mounting post proximate the end of the at least one mounting post. Yet further included is a circuit breaker mechanism frame operatively coupled to a circuit breaker mechanism, the circuit breaker frame defining at least one aperture aligned with the at least one mount hole. Also included is at least one pin extending through the at least one mount hole and the at least one aperture to retain the circuit breaker mechanism to the base.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
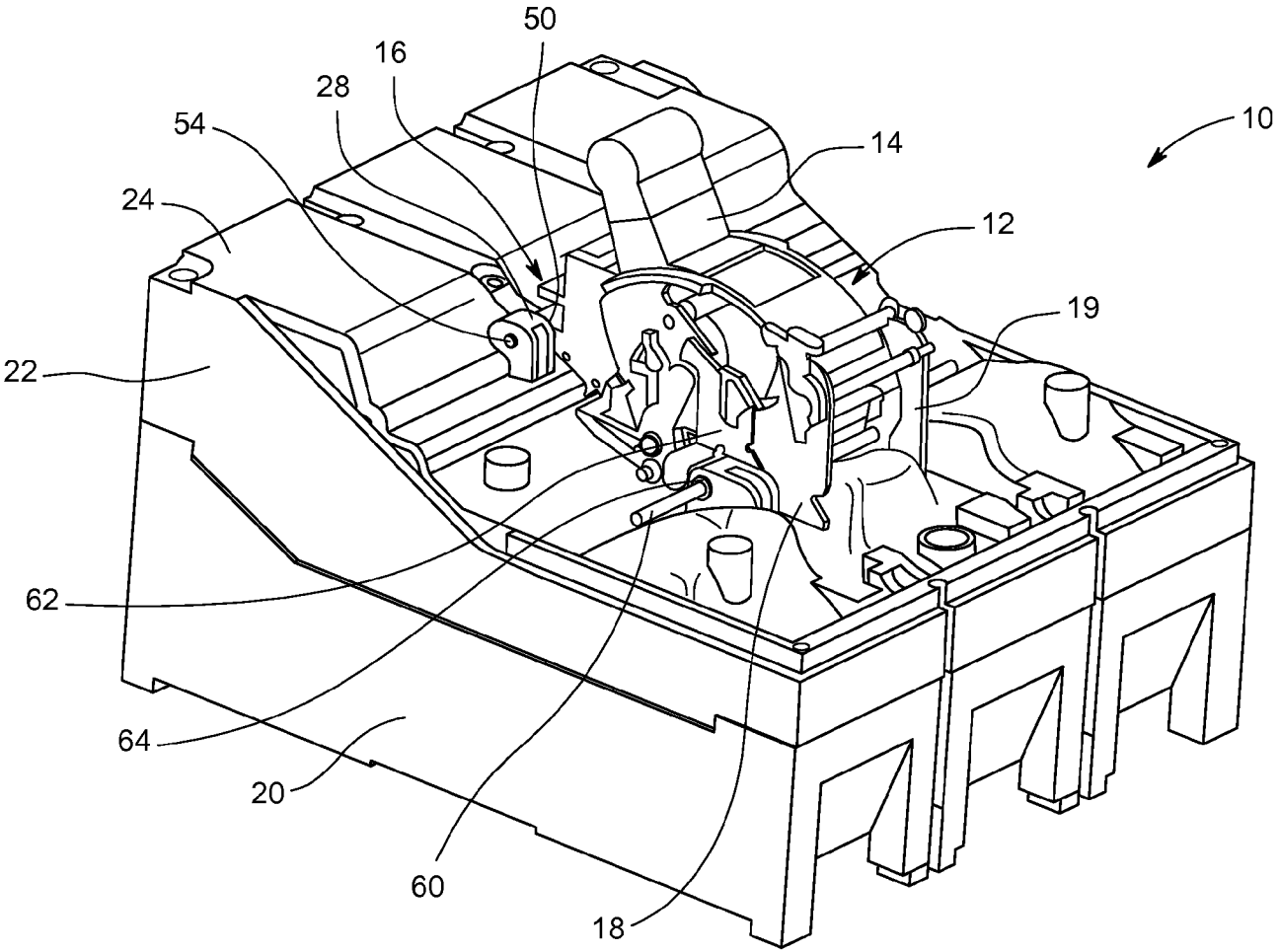
FIG. 1 is a perspective view of a circuit breaker.

Referring to FIG. 1, a circuit breaker 10 of the multi-pole variety is partially illustrated. The circuit breaker 10 has an outer cover removed to better illustrate various components of the circuit breaker 10 that are relevant to the embodiments of the invention described herein. The circuit breaker 10 includes a mechanism that is generally referenced with numeral 12. The mechanism 12 includes a number of components configured to detect a hazardous or undesirable operating condition and to initiate switching the circuit breaker 10 to a tripped or closed condition. Additionally, manual manipulation of the position of the circuit breaker 10 is facilitated with a handle 14 that may be actuated by an operator. This gives the operator the ability to turn the circuit breaker 10 "ON" to energize a protected circuit, turn the circuit breaker "OFF" to disconnect the protected circuit breaker, or reset the circuit breaker after a fault. Overall, the mechanism 12 converts movement of the handle 14 into mechanical force to operate the circuit breaker 10. The circuit breaker 10 illustrated depicts a three-phase configuration, however, the embodiments disclosed herein are not limited to this configuration, such that alternate phase configurations (e.g., one-phase, two-phase, four-phase, etc.) may be employed. The mechanism 12 comprises a frame assembly 16 that includes a first side frame 18 and a second side frame 19 that assist in retaining the overall mechanism assembly together and provides a structure for mounting to other components.

A base 20 and a mid-cover 22 define a cavity where various circuit breaker components (not shown) are housed, including a line strap to which the mechanism is to be electrically connected. The circuit breaker components within the cavity are "live" components from which the mechanism 12 is to be isolated. To achieve isolation, the mechanism 12 is mounted to an outer surface 24 of the mid-cover 22, as shown. However, isolating the mechanism 12 must also include connecting the mechanism 12 to the base 20, which will be described in detail below.

Figure 2:
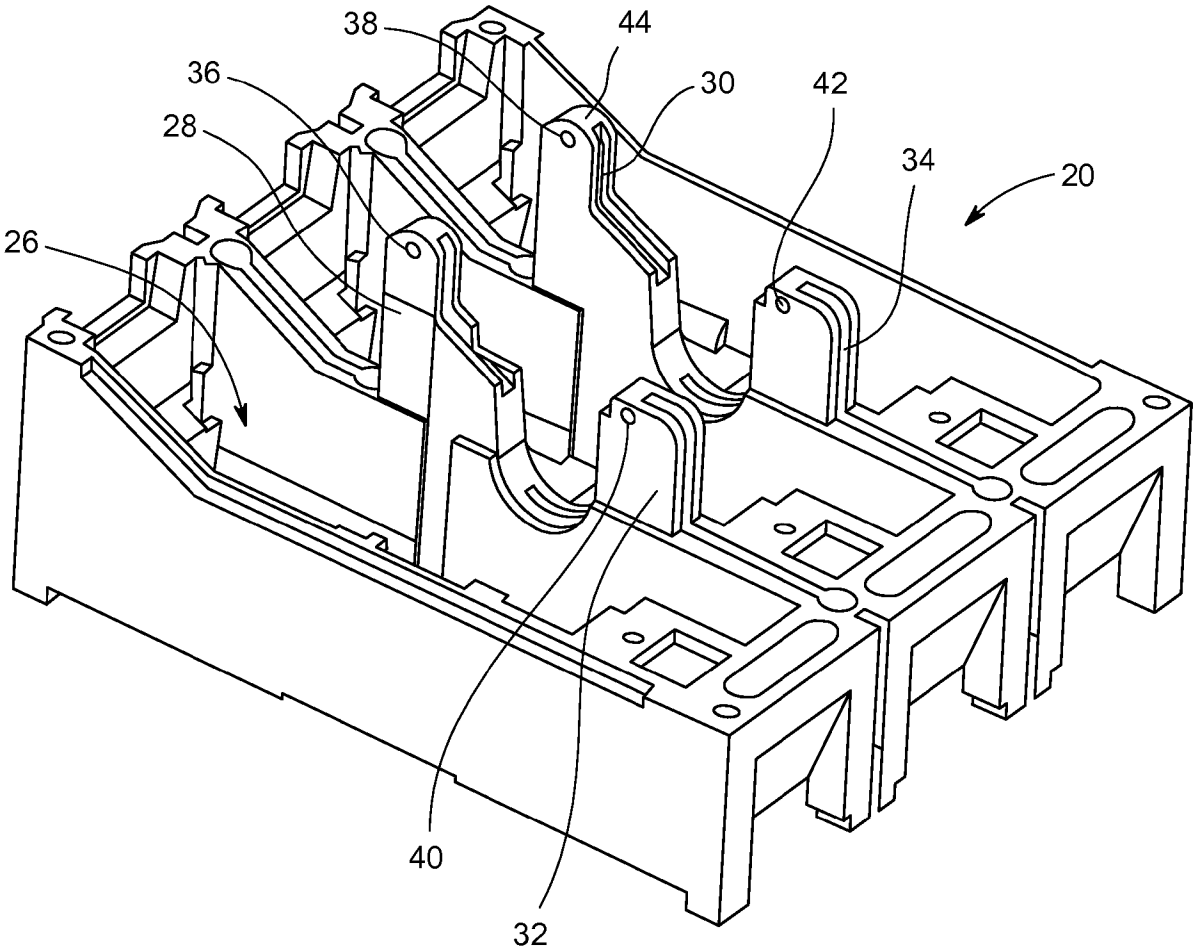
FIG. 2 is a perspective view of a base of the circuit breaker.
Figure 3:
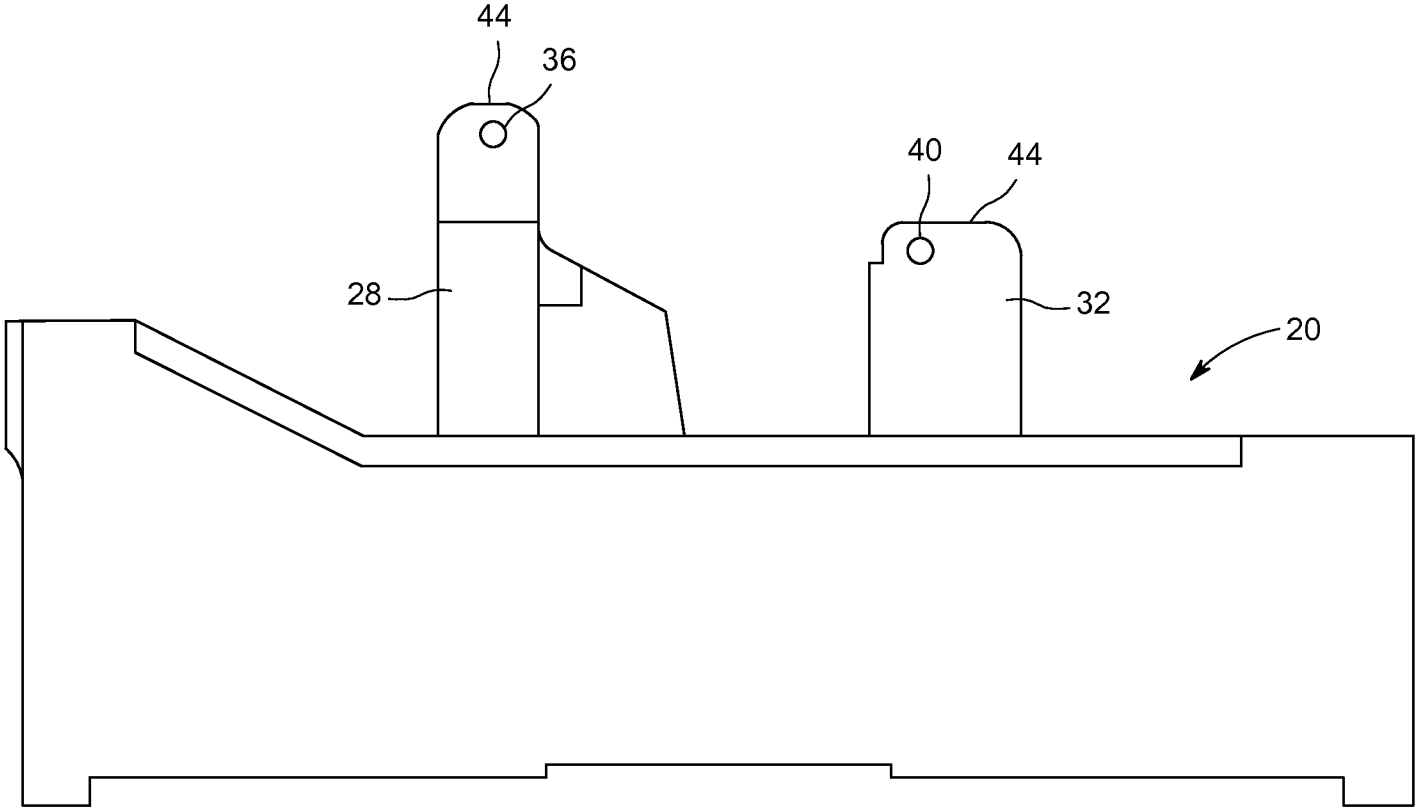
FIG. 3 is a side, elevation view of the base.

Referring now to FIGS. 2 and 3, the base 20 is illustrated in greater detail by removal of the mid-cover 22 and the mechanism 12. The base 20 includes a plurality of channels 26 that correspond to the number of phases of the circuit breaker 10. The base 20 includes at least one, but typically a plurality of mounting posts that extend from the base 20. In the illustrated embodiment, the mounting posts extend from walls that define the plurality of channels 26. It is contemplated that any number of mounting posts may be employed. In the exemplary embodiment shown, a first pair of mounting posts and a second pair of mounting posts are included. The first pair includes a first mounting post 28 and a second mounting post 30, while the second pair includes a third mounting post 32 and a fourth mounting post 34.

Each of the mounting posts includes a mount hole defined by the respective mounting post. For example, the first mounting post 28 includes a first mount hole 36, the second mounting post 30 includes a second mount hole 38, the third mounting post 32 includes a third mount hole 40, and the fourth mounting post 34 includes a fourth mount hole 42. In the illustrated embodiment, the mount holes are located proximate an outer end 44 of the respective mounting posts. As will be appreciated from the description herein, the position of the mounting posts, and hence the mount holes, corresponds to positioning of the mechanism 12. In particular, the mount holes are each aligned with respective apertures of the frame assembly 16, which facilitates coupling of the mechanism 12 to the mounting posts of the base 20.

Figure 4:
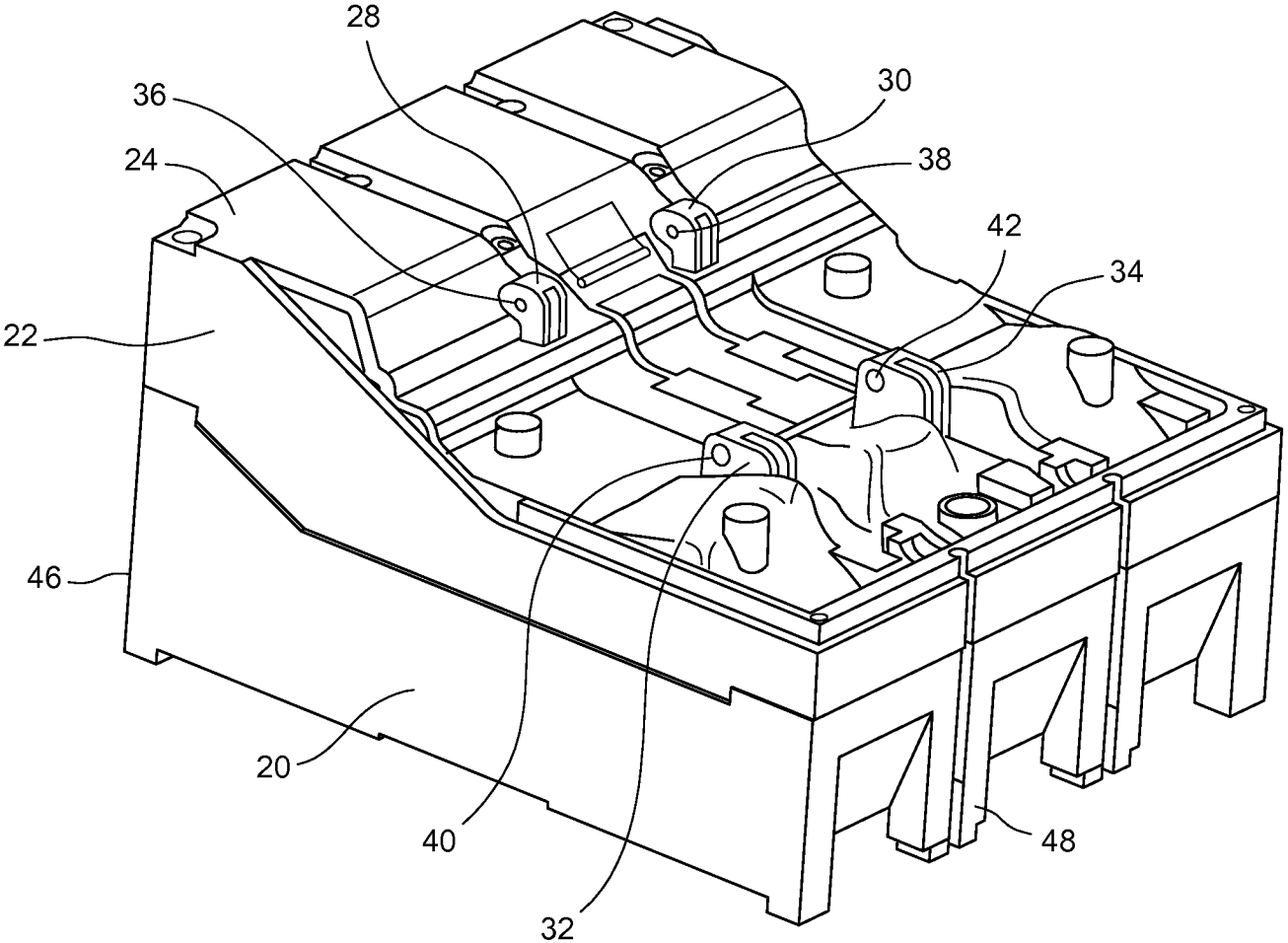
FIG. 4 is a perspective view of the base and a mid-cover of the circuit breaker.
Figure 5:
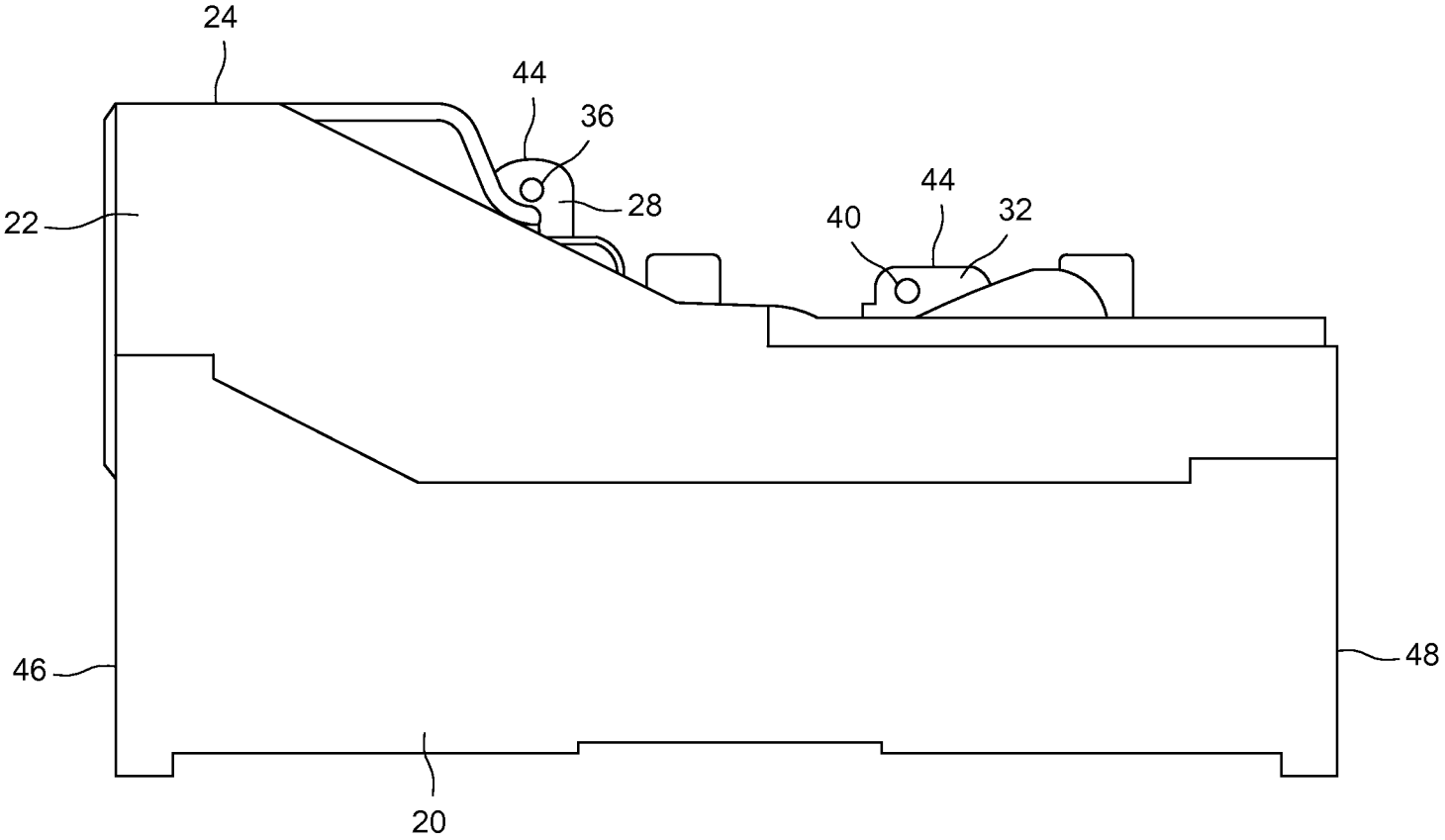
FIG. 5 is a side, elevation view of the base and the mid-cover.

Referring to FIGS. 4 and 5, the mid-cover 22 is illustrated in an adjacent position relative to the base 20. As shown, the mounting posts, 28, 30, 32, 34 are of sufficient dimension to protrude through the mid-cover 22. As described above, the location of the mounting posts may vary depending on the particular application, but in the illustrated embodiment, the first pair of mounting posts (i.e., the first mounting post 28 and the second mounting post 30) are located closer in proximity to a forward edge 46 of the base 20 than to a rear edge 48 of the base 20. Conversely, the second pair of mounting posts (i.e., the third mounting post 32 and the fourth mounting post 34) is located closer in proximity to the rear edge 48 of the base 20 than to the forward edge 46 of the base 20.

Referring again to FIG. 1, the mechanism 12 is referred to once more to illustrate mounting of the mechanism 12 to the outer surface 24 of the mid-cover 22. In one embodiment, the mechanism 12 is disposed completely externally to the cavity defined by the base 20 and the mid-cover 22. Such a configuration allows isolation of the mechanism 12 from the "live" components disposed on the other side of the mid-cover 22. However, as noted above, the mechanism 12 must be connected to the base 20 and retained thereto. This is accomplished by coupling the mechanism 12 to the mounting posts 28, 30, 32 and 34. In particular, the frame assembly 16 includes a first frame aperture 50 defined by the first side frame 18 and a second frame aperture defined by the second side frame 19. The first frame aperture 50 and the second frame aperture (not shown) are aligned with each other, as well as with the first mount hole 36 and the second mount hole 38. A first pin 54 extends through the first mount hole 36, the first frame aperture 50, the second frame aperture and the second mount hole 38 to retain the mechanism 12 to the first mounting post 28 and the second mounting post 30.

The frame assembly 16 also includes a third frame aperture (not shown) defined by the first side frame 18 and a fourth frame aperture (not shown) defined by the second side frame 19. As can be appreciated with reference to the drawings, some of the frame apertures are not visible simply based on their relative positioning with the other components and based on the presence of the pins inserted therein. The third frame aperture and the fourth frame aperture are aligned with each other, as well as with the third mount hole 40 and the fourth mount hole 42. A second pin 60 extends through the third mount hole 40, the third frame aperture, the fourth frame aperture and the fourth mount hole 42 to retain the mechanism 12 to the third mounting post 32 and the fourth mounting post 34.

It is to be appreciated that the first pin 54 and the second pin 60 may extend through other apertures or holes to facilitate retention of the mechanism 12 to the base 20. For example, as shown in the illustrated embodiment, a reset lever 62 is operatively coupled to the mechanism 12 proximate at least one of the frame sides. As shown, the reset lever 62 is coupled to the mechanism 12 at the first side frame 18 proximate the third frame aperture and the third mount hole 40. The reset lever 62 defines at least one reset lever aperture 64 that is aligned with the third mount hole 40, the third frame aperture, the fourth frame aperture and the fourth mount hole 42. Based on the alignment of these features, the second pin 60 extends therethrough. It is to be understood that another reset lever aperture may be disposed on both sides of the third mounting post 32.

In addition to retaining the mechanism 12 to the base 20, one or both of the first pin 54 and the second pin 60 may advantageously provide a retention force between the mid-cover 22 to the base 20. Typically, the mid-cover 22 is retained to the base 20 with a plurality of screws. However, the number of screws required may be reduced with the additional retention force of the first pin 54 and/or the second pin 60. In the illustrated embodiment, the first pin 54 is disposed in close proximity to the outer surface 24 of the mid-cover 22, such that slight movement of the mid-cover 22 results in contact with the first pin 54, which then hinders additional movement of the mid-cover 22. In another embodiment, the first pin 54 is in contact with the outer surface 24 of the mid-cover 22, such that no movement of the mid-cover is permitted.

Advantageously, a mounting assembly for the mechanism 12 is formed by the components described above. The assembly allows for isolation of the mechanism 12 from the "live" components disposed near the bottom end of the base 20, while still providing direct coupling of the mechanism 12 to the base 20 via the mounting posts. The direct mounting reduces tolerance stack-up and other manufacturing issues that add time and cost to the overall design of the circuit breaker 10.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A mounting assembly for a circuit breaker mechanism frame coupled to a circuit breaker mechanism, the assembly comprising:

a base;

a mid-cover;

a first pair of mounting posts comprising a first mounting post and a second mounting post, a first end of each of the pair of mounting posts coupled to the base and extending therefrom, a second end of each of the pair of mounting posts protruding through the mid-cover, and disposed at a distal location from the base;

a first mount hole defined by the second end of the first mounting post and a second mount hole defined by the second end of the second mounting post, and a first pin extending through the first mount hole, the second mount hole, and the circuit breaker mechanism frame to retain the circuit breaker mechanism to the base.

2. The mounting assembly of claim 1, wherein the first pin extends through a first frame aperture defined by a first side frame of the circuit breaker mechanism frame and a second frame aperture defined by a second side frame of the circuit breaker mechanism frame.

3. The mounting assembly of claim 2, further comprising:

a second pair of mounting posts comprising a third mounting post and a fourth mounting post coupled to and extending from the base, the second pair of mounting posts each protruding through the mid-cover;

a third mount hole defined by the third mounting post and a fourth mount hole defined by the fourth mounting post; and a second pin extending through the third mount hole, the fourth mount hole and the circuit breaker mechanism frame to retain the circuit breaker mechanism to the base.

4. The mounting assembly of claim 3, wherein the second pin extends through a third frame aperture defined by the first side frame of the circuit breaker mechanism frame and a fourth frame aperture defined by the second side frame of the circuit breaker mechanism frame.

5. The mounting assembly of claim 4, further comprising:

a reset lever operatively coupled to the circuit breaker mechanism proximate at least one of the first side frame and the second side frame; and a reset lever aperture aligned with the third frame aperture and the fourth frame aperture, the second pin extending therethrough.

6. The mounting assembly of claim 3, wherein the base comprises a forward edge and a rear edge, the first pair of mounting posts located closer in proximity to the forward edge than to the rear edge, the second pair of mounting posts located closer in proximity to the rear edge than to the forward edge.

7. The mounting assembly of claim 1, wherein the first pin is disposed in close proximity to an outer surface of the mid-cover to retain the mid-cover to the base.

8. The mounting assembly of claim 7, wherein the first pin is in contact with the outer surface of the mid-cover to retain the mid-cover to the base.

9. The mounting assembly of claim 1, wherein the circuit breaker mechanism is positioned on the outer surface of the mid-cover.

10. The mounting assembly of claim 9, wherein the circuit breaker mechanism is disposed completely externally to a cavity defined by the base and the mid-cover.

11. The mounting assembly of claim 1, wherein the base includes a plurality of walls defining a plurality of channels therebetween, and wherein the first pair of mounting posts extend from at least one of the plurality of walls.

12. A circuit breaker comprising:

a base;

a mid-cover disposed adjacent the base;

at least one mounting post extending from the base and protruding through the mid-cover, the at least one mounting post having an end located at a distal location from the base;

at least one mount hole defined by the at least one mounting post proximate the end of the at least one mounting post;

a circuit breaker mechanism frame operatively coupled to a circuit breaker mechanism, the circuit breaker frame defining at least one aperture aligned with the at least one mount hole; and at least one pin extending through the at least one mount hole and the at least one aperture to retain the circuit breaker mechanism to the base.

13. The circuit breaker of claim 12, wherein the at least one mounting post comprises a first mounting post, a second mounting post, a third mounting post and a fourth mounting post, wherein the at least one mount hole comprises a first mount hole defined by the first mounting post, a second mount hole defined by the second mounting post, a third mount hole defined by the third mounting post and a fourth mount hole defined by the fourth mounting post.

14. The circuit breaker of claim 13, the circuit breaker mechanism frame comprising a first side frame and a second side frame, wherein the at least one pin comprises a first pin and a second pin, the first pin extending through the first mount hole, the second mount hole, a first frame aperture defined by the first side frame and a second frame aperture defined by the second side frame, the second pin extending through the third mount hole, the fourth mount hole, a third frame aperture defined by the first side frame and a fourth frame aperture defined by the second side frame.

15. The circuit breaker of claim 14, further comprising:

a reset lever operatively coupled to the circuit breaker mechanism proximate at least one of the first side frame and the second side frame; and a reset lever aperture aligned with the third frame aperture and the fourth frame aperture, the second pin extending therethrough.

16. The circuit breaker of claim 13, wherein the base comprises a forward edge and a rear edge, the first mounting post and the second mounting post located closer in proximity to the forward edge than to the rear edge, the third mounting post and the fourth mounting post located closer in proximity to the rear edge than to the forward edge.

17. The circuit breaker of claim 12, wherein the at least one pin is disposed in close proximity to an outer surface of the mid-cover to retain the mid-cover to the base.

18. The circuit breaker of claim 17, wherein the at least one pin is in contact with the outer surface of the mid-cover to retain the mid-cover to the base.

19. The circuit breaker of claim 12, wherein the circuit breaker mechanism is positioned on an outer surface of the mid-cover.

20. The circuit breaker of claim 19, wherein the circuit breaker mechanism is disposed completely external to a cavity defined by the base and the mid-cover.

* * * * *